United States Patent [19]

Schudy et al.

[11] 4,070,073

[45] Jan. 24, 1978

[54] FILING DEVICE FOR PAPERS

[75] Inventors: Karl-Heinz Schudy, Espelkamp; Heinz Kleinert, Lubbecke, both of Germany

[73] Assignee: Robert Krause KG, Espelkamp, Germany

[21] Appl. No.: 699,773

[22] Filed: June 25, 1976

Related U.S. Application Data

[62] Division of Ser. No. 551,802, Feb. 20, 1975, Pat. No. 3,993,374.

[30] Foreign Application Priority Data

| | | |
|---|---|---|
| Sept. 24, 1974 | Germany | 2445451 |
| Jan. 17, 1975 | Germany | 2501721 |

[51] Int. Cl.[2] ..... A47B 63/00; B42F 15/00; B42F 3/04

[52] U.S. Cl. ..... 312/184; 402/38

[58] Field of Search ..... 312/184, 183; 402/4, 402/38

[56] References Cited

U.S. PATENT DOCUMENTS

| | | | |
|---|---|---|---|
| 1,973,174 | 9/1934 | Lotter | 402/4 |
| 1,996,463 | 4/1935 | Dawson et al. | 402/38 |
| 2,612,169 | 9/1952 | Segal | 402/38 |
| 3,077,888 | 2/1963 | Thieme | 402/38 |
| 3,098,489 | 7/1963 | Vernon | 402/38 |
| 3,190,293 | 6/1965 | Schneider et al. | 402/4 |
| 3,628,877 | 12/1971 | Barnes, Jr. | 402/4 |
| 3,801,175 | 4/1974 | Giulie | 312/184 |
| 3,884,586 | 5/1975 | Michaelis et al. | 402/38 |

FOREIGN PATENT DOCUMENTS

| | | | |
|---|---|---|---|
| 658,733 | 1/1963 | Italy | 402/38 |
| 759,198 | 12/1956 | United Kingdom | 402/4 |
| 449,445 | 9/1936 | United Kingdom | 402/4 |

*Primary Examiner*—Paul R. Gilliam
*Assistant Examiner*—Victor N. Sakran
*Attorney, Agent, or Firm*—Frank J. Jordan

[57] ABSTRACT

A ring binder device for a file serves to hold documents and to provide a means whereby the file can be suspended spine uppermost between two carrier rails, the device having slidemounted suspender members which can be set, by moving their slide mountings, to protrude beyond the edges of the file ready for resting on the rails, and the slide mountings incorporating locks operative when the suspender members are protruding to prevent the binder opening.

14 Claims, 20 Drawing Figures

1
21
23
14
18'
11
8
120
17
18
5
6
2
7
4
3
9
8
18
17
121
11
21
18'
23

61
63
55
11
57
56
59
65
66
520
60
7
9
64
64
58
8
3
5
6
64
64
10'
10'
53
58
521
60
15
66
65
59
56
62
57
63
55
61
11

FILING DEVICE FOR PAPERS

This is a division, of application Ser. No. 551,802, filed Feb. 20, 1975 now U.S. Pat. No. 3,993,374.

PRIOR APPLICATIONS

Priority, Federal Republic of Germany, Sept.24, 1974 application No. P 24 45 451.1 and Priority, Federal Republic of Germany, Jan. 17, 1975 application No. P 25 01 721.4.

The present invention relates to filing devices for papers.

More particularly, the present invention relates to filing devices which incorporate ring binding mechanisms attachable to the inside of a protective file cover.

Prior filing equipment of this kind can be stored in a standing attitude or laid flat, but cannot be employed in a hanging storage system because the ring parts, which are held together simply by the spring load of the mechanism, can open if the documents on file spread out and exert a greater opening force on the ring parts than the resisting spring loading.

The object of the present invention is device equipment of the ring binder type which is simple in construction but which can nevertheless be suspended on carrier rails if wished without risk of the binder opening under load produced by filed documents.

According to the present invention, there is provided a filing device comprising a ring binding mechanism for attachment to the inside of a protective file cover or the like, wherein the mechanism includes a spring cover, associated ring carrying elements and ring components carried pairwise thereby for rocking movement allowing the mechanism to be opened and closed, and a slide at each end of the ring mechanism capable of limited displacement along the ring mechanism, each slide incorporating a locking element engageable with the ring carrying elements to secure the ring components of the ring mechanism against opening when the slide is displaced to an operative position, the slide having an outer end formed into or incorporating a suspension element which, in the operative position of the slide, extends beyond the corresponding end of the ring mechanism and enables the device to be rested upon a file carrier. The invention also comprehends a file incorporating such a device.

With filing equipment embodying the invention it is possible, by a simple pull-out movement of the two slides, to place these in an operative position in which the ring components of the ring mechanism are reliably locked to secure them against any inadvertent opening, and in which the filing equipment is adapted to be suspended from carrier rails. A simple action of sliding back the slides into an inoperative position, is sufficient to unlock the ring mechanism (and return all the components of the mechanism to within the profile of the protective cover so that the filing equipment can be handled and stored upright or flat in the same way as a conventional ring binder file.)

Advantageously, the slides each comprise a flat main section displaceably assembled beneath the ring mechanism and possessing an upstanding hook-like tongue serving as the locking element, the free end of the tongue facing towards the outer end of the slide. Such a design facilitates particularly simple guidance and housing of the slide, with reliable locking and unlocking of the ring mechanism.

Devices for attachment to the spine of a file cover can employ the outer end of the slide itself, when in the operative position, as the suspension element, and if lateral upstanding edge flanges are formed on the main section of the slide, then the top edges of these flanges can define the support zone. The support plane then extends parallel to the plane of the main section of the slide and therefore parallel to the spine of an associated file cover. This makes it possible to suspend the file between two parallel carrier rails, the wide support zones formed by the ends of the slides counteracting a tendency for the file to tilt should the filed documents exert an off-centre load: the entire unit can then adopt a positionally stable, vertical suspended attitude. Alternatively, the outer end of the slide could incorporate a separate or an integral suspension element which is angled in relation to the plane of the main section of the slide, with a support zone thereof facing one of the narrow sides of the slide. The filing device can then be attached to the back cover section of a file cover instead of to the spine, thereby allowing the file to be suspended with its spine facing upwards.

If a file suspension system is employed which utilises a single strip or rail-type suspension carrier, then filing equipment embodying this invention can be suspended below such a carrier if the suspension element is formed by a suspension bracket which is pivotally assembled on the bottom edge of a transverse flange formed at the outer end of the main section of the slide, pivoting taking place about an axis parallel to said edge. It is advantageous for the suspension bracket to pivot through about 180° from an inoperative position to a suspension position in which it extends along the outside of the transverse flange and for a support zone of the bracket to project beyond the transverse flange (and beyond the external profile of an associated file cover).

In some situations, the suspension carriers are permanent fixtures in record office racks and office furniture etc. and are designed such that dimensionally they correspond with the larger document sizes. Desirably, equipment embodying the invention is adaptable to suit such fixtures and to allow smaller sized equipment to be suspended therefrom. Accordingly, an embodiment of the invention has slides designed as holders for substantially U-shaped suspension brackets which themselves can be pulled out and slid in with respect to the slides. This design, in which the suspension bracket forms a kind of telescopic extension of the slide, makes it possible to hang, for instance, a DIN A 5 standard size file on suspension carriers intended for accommodating files of DIN A 4 standard size.

Another embodiment of the invention, has a substantially U-shaped suspension bracket coupled to the slide in order to move therewith, the bracket being pivotable relative to the slide about an axis which is parallel to the direction of displacement motion of the slide, and the bracket being disposed to one side of the slide. The slide can be relatively small and delicate, yet can be combined with relatively large and strong suspension brackets of the kind required when dealing with heavy units which impose particular loads on a suspension system.

Embodiments of the invention will now be described by way of example only with reference to the accompanying drawings, in which.

Figure 1:
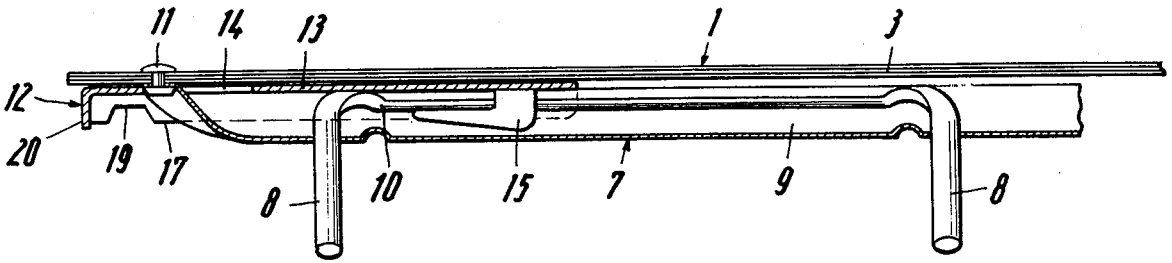
FIG. 1 illustrates a simplified, cut-away illustration, partially in section, of a filing device forming a first embodiment of the invention, wherein slides of the device are shown in a pushed-in or retracted position.

The filing devices shown in the drawings are intended generally to be fitted to a protective cover, which has only been illustrated in full in four of the Figures. The cover is in the form of a file cover 1 having a front board 2, a spine 3 and a back board 4, the spine 3 being separated from the boards 2, 4 by folds 5, 6.

Figure 2:
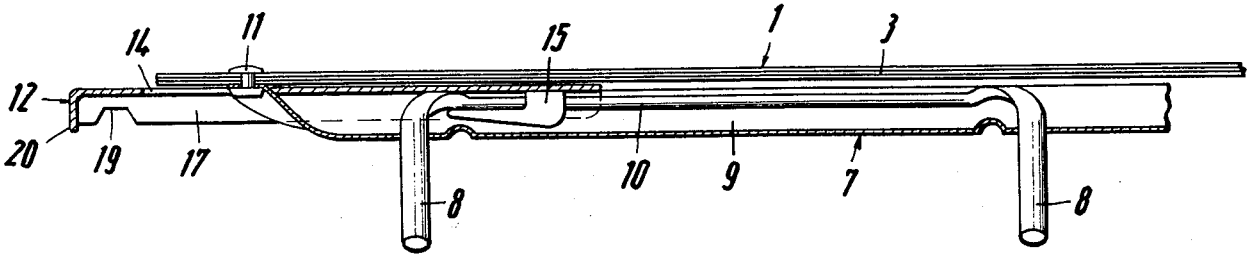
FIG. 2 is an illustration similar to FIG. 1, showing the slides pulled out into their operative positions.
Figure 3:
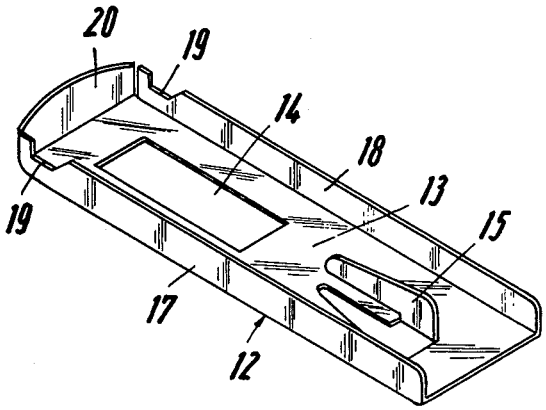
FIG. 3 is a perspective view of a slide employed in the filing device shown in FIGS. 1 and 2.

In the embodiment shown in FIGS. 1 to 3, there is a ring mechanism attached to the spine 3 of the protective cover 1, only the left hand half of the mechanism 7 having been shown. The basic structure of the ring mechanism is very well known and requires no detailed description here. It comprises ring components 8 which are held together in a closed position by the spring action of a springy cover strip 9, and which open when rail or wire coil sections 10, located inside the mechanism, are raised beyond a top dead centre point. Rivets 11 secure the ring mechanism 7 to the spine 3.

The filing device furthermore comprises two slides, one at each end of the ring mechanism 7. The slides engage beneath the ring mechanism and are held between the latter and the spine 3 of the file cover 1, in such a fashion that they can perform a limited displacement in a direction lengthwise with respect to the mechanism 7 and the spine 3. Only the left hand one of the two slides is visible in FIGS. 1 and 2 and this has been marked 12. The detailed design of these slides, which are virtually identical to one another, can be seen in FIG. 3. The slide 12 has a flat main section 13 in which there is an elongated hole 14. The rivet 11 passes through this elongated hole 14 and thus limits the extent to which the slide 12 can be displaced when pulled out or pushed in. In the neighbourhood of an inner end of the slide 12 there is a raised tongue 15 acting as a locking element and, when the slide 12 is pulled out into an operative position for suspension from a carrier rack, the tongue slides over the rail or wire coil sections 10 of the ring components 8 in the neighbourhood of the juncture therebetween. This juncture defines a pivot axis about which the ring components move when opened and closed. When the slide 12 is pulled out, opening of the ring components 8 is prevented by the tongue 15. The tongue 15 faces with its free end towards the outer end of the slide 12 and has a wedge-like or tapered form, facilitating its sliding over the rail or wire coil sections 10. In contrast to the embodiment shown in FIG. 3, the tongue 15, as shown for example in FIG. 6, can be arranged upon a cantilevered section 16 of the slide having limited facility for elastic displacement out of the plane of the main slide section 13, so as to compensate for differences in the distance between the central zone of the rail or wire coil sections of the ring mechanism and the bottom marginal edges of the mechanism cover strip 9.

Along the lateral edges of the main section 13 the slide 12 is equipped with upstanding marginal flanges 17, 18 which embrace the mechanism cover strip 9 and guide the slide while it is being displaced. Adjacent an outer end of the slide 12, the marginal flanges 17, 18 are provided with notches 19, and these notches define and delimit a support zone. The outer end of the slide 12 terminates in a transverse flange 20 bent up at right angles to the plane of the main section 13 and serving as a grip by which to actuate the slide 12.

FIG. 1 illustrates the slide 12 in a pushed-in position in which, like its counterpart (not shown) at the right-hand end of the ring mechanism 7, its locking tongue 15 releases the wire coil sections 10 for movement allowing opening and closing of the mechanism and thereby allowing for the unrestricted introduction and removal of documents. At the same time, the slide 12 is wholly within the profile of the protective cover 1 so that the file can be handled just like any other file of this basic type. If it is intended to store the file suspended with its spine uppermost, then the slide 12 and its right-hand counterpart are moved into the operative position shown in FIG. 2, i.e. are pulled out into a position wherein their outer ends project beyond the profile of the protective cover 1. The notches 19 in the marginal flanges 17, 18, are then positioned to support the file upon carrier rails or the like. The support plane defined by the notches in the slides is generally parallel to the plane of the the spine 3. When the slides are moved into the operative position, their locking tongues 15 slide over the wire coil sections 10 and locks them in a bottom dead centre position, correspondingly locking the ring components 8 closed, so that said components 8 are secured against inadvertent opening. To restore the condition shown in FIG. 1, (allowing the mechanism 7 to be opened and closed) it is simply necessary to push the two slides inwardly towards one another, something which can be done with a single movement of the hand, in just the same way as the pulling-out operation.

Figure 5:
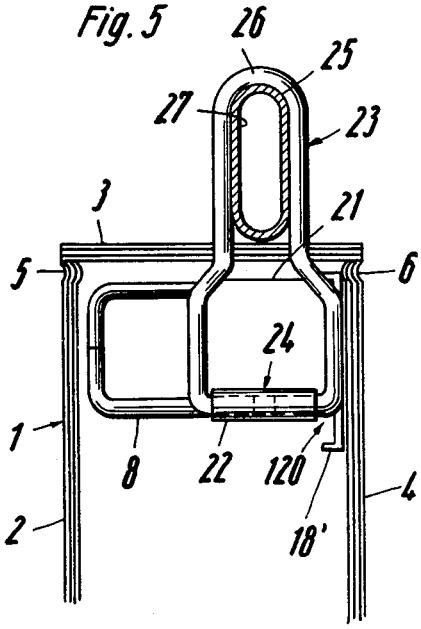
FIG. 5 is an end elevation of the arrangement shown in FIG. 4 in the suspended position, again with the protective cover cut away.
Figure 4:
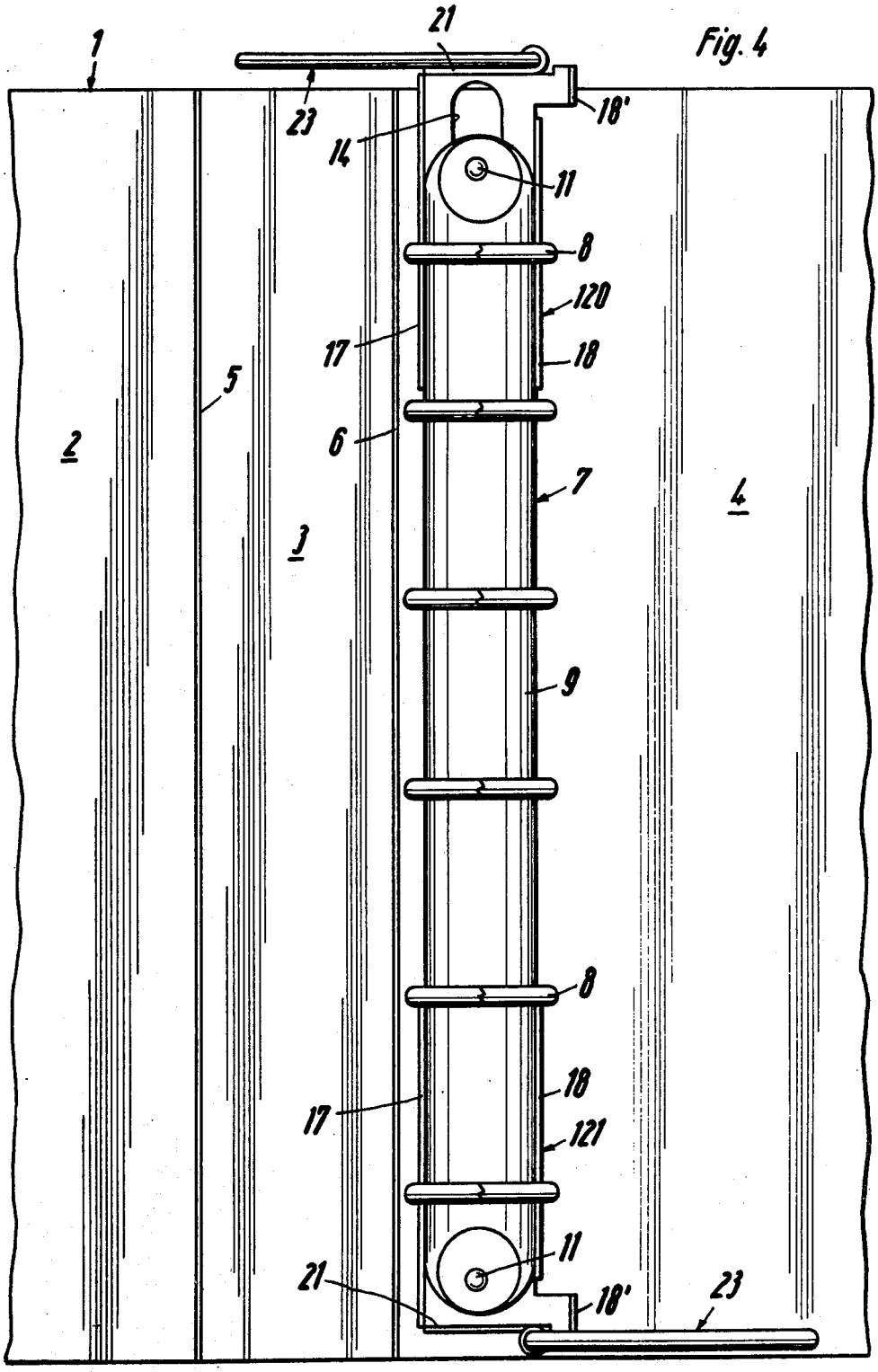
FIG. 4 is a plan view of a filing device forming a second embodiment of the invention, showing an associated protective file cover in cut-away fashion.
Figure 6:
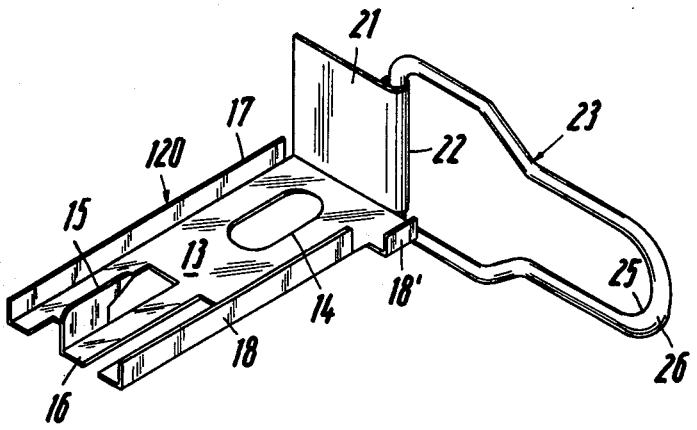
FIG. 6 illustrates in perspective a slide and suspension element of the filing device shown in FIGS. 4 and 5.

FIGS. 4 to 6 illustrate an embodiment in which the ring mechanism, the design of which corresponds to that of the ring mechanism 7, is constructed for attachment to the back board 4 of the protective cover 1. As FIG. 4 shows, the mechanism extends close to and parallel with the spine 3. In order to make possible suspended storage of the file with its spine 3 uppermost, this filing device comprises two slides 120, 121 which, like slides 12, are virtually identical to one another; the slides are therefore mirror-symmetrical about a central plane passing traversely through the ring mechanism.

The slide 120 at the top of FIG. 4 is illustrated in its pulled-out, operative position, in which its outer end projects outwardly beyond the profile of the protective cover 1. The pushed-in condition is demonstrated by the slide 121 at the bottom of FIG. 4, its outer end being located within the profile of the protective cover 1. As the illustration of the slide 120 in FIG. 6 shows in more detail, this slide is broadly similar to the slide 12. However, the slide 120, 121, is provided at its outer end with a suspension element which, as shown in FIGS. 4 to 6, comprises a transverse flange 21 provided at the transverse edge of the main section 13 of the slide and disposed at right angles to the plane thereof. Flange 21 has an edge 22, which is the bottom edge when the file is suspended (FIG. 5), bearing a suspension bracket 23, the latter being pivotable about an axis parallel to the said edge. In the illustrated example, where, as in the other examples, the slide is formed by a punching operation, the transverse flange 21 is formed by a folded flange on the main section 13, and the pivot bearing for the suspension bracket 23 consists of a rolled zone 24 of the flange. The rolled zone 24 receives oppositely and inwardly directed ends of the suspension brackets 23. The brackets 23 are formed from round-section wire.

The suspension bracket has been shown in an inoperative position in FIG. 6, which position it adopts when the slide 120 is pushed inwardly. This is the position which has been shown in an analogous way for the suspension bracket 23 of the slide 121 in FIG. 4. From this inoperative position, the suspension bracket can be pivoted through 180° into a suspension position, as shown in FIGS. 4 and 5 in relation to the slide 120. In this position, the suspension bracket 23 extends along the outwardly facing surface of the flange 21 and a section 26 defining a support zone 25 then projects beyond the external profile of the associated protective cover 1. The support zone 25 of the projecting bracket section 26 forms a non-circular opening for the passage of a strip-type, rail-type or tubular suspension carrier 27. Owing to the shape of the opening, the file complete with its protective cover and any documents therein, always occupies a vertical attitude in which the boards 2, 4 and the stock of document pages extend vertically, in spite of any tendency for the load carried by the bracket section 26 to tilt the file.

In order to fix the inoperative position of the suspension bracket 23, the slide 120 is provided at the corner of its main section 13 adjacent the bearing edge 22 of the transverse flange 21, with a stop formed in the illustrated example by an outwardly-displaced end portion 18' of the edge flange 18. The stop could equally well be formed by any other suitable projection, folded portion or the like.

In normal usage when both slides 120, 121 are in the pushed-in position, the suspension brackets 23 are folded down as illustrated in the case of the slide 121 shown in FIG. 4. To place the ring mechanism in a condition for suspension, both slides 120, 121 are pulled out and the suspension brackets 23 are folded through 180° to position them as illustrated by the top slide 120 in FIG. 4. In this position the ring mechanism is locked, so that the ring components 8 cannot open, by means of the locking tongues 15, in the same manner as already described with reference to FIGS. 1 to 3. In the operative position, the file together with the protective cover and any documents therein can be slid on to a suspension carrier 27, the carrier extending parallel to and spaced above the spine 3 of the protective cover 1.

Figure 8:
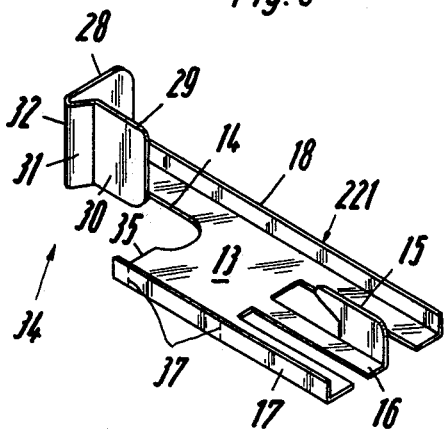
FIG. 8 illustrates in perspective a slide of the filing device shown in FIG. 7.
Figure 7:
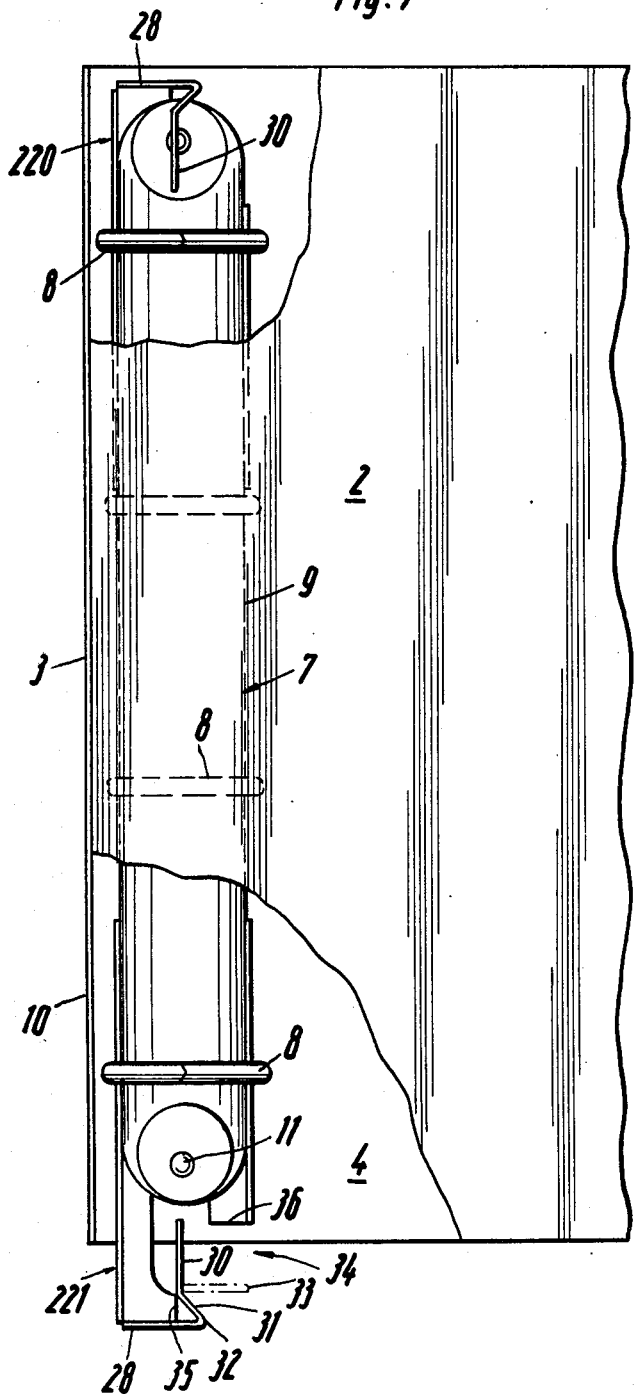
FIG. 7 is a cut-away, partially exploded plan view of a protective file cover equipped with a filing device representing a third embodiment of the invention.

FIGS. 7 and 8 illustrate another embodiment which is broadly similar to that shown in FIGS. 4 to 6, with the exception of the design of the slides.

The slides 220, 221, which are once again mirror-symmetrical one to the other, are distinguished from slides 120, 121 by the design of the external support or suspension zone. The suspension element shown in FIGS. 7 and 8 comprises a transverse flange 28 upstanding from an outer end of the main section 13 and perpendicular to the plane thereof. This flange 28 has an extension 29 which projects inwardly towards the middle of the main section 13 and presents a support surface 30 coinciding substantially with an imaginary, longitudinal central plane passing perpendicularly through the main section 13 of the slide. This support surface 30 is delimited towards the outermost end of the slide by a chamfer or inclined portion 31 which extends from the support surface 30 to the edge 32, of the transverse flange 28. Edge 32 is the lower most edge of flange 28 when the file is suspended. The inclined portions 31 on the slides 220, 221, limit motions in the longitudinal direction of the ring mechanism 7, which a file suspended on two mutually parallel suspension carriers 33 might execute. Moreover, the portions 31 help to centre the file when suspended between the carriers 33. The width of the support surface 30, considered that is in a direction perpendicular to the plane of the main section 13, sufficiently large as to counteract tilting movements on the part of the file when suspended. The width is such, however, as not to impede exchange of pages of documentation which have been perforated and filed on the ring components 8. This purpose is also served by locating the extension 29 in the vertical longitudinal central plane through the main section 13. At the same time, a space is left between the top of the spine 3 and the support surface 30, this space taking account of the normal dimensions which conventional suspended files exhibit in this direction.

The slides 220, 221 are made once again as pressings or punchings and the parts 28, 29, 30, 31, 32 are again created by folding a flange provided on the main section 13. Because the support surface 30 of each slide lies at the level of the aforesaid imaginary central plane, each main slide section 13 contains an opening or recess 34 located to one side of the support surface 30 so as to create the requisite access for the suspension carrier 33. The provision of this recess involves the omission of part of the main section 13 which would otherwise have surrounded one side of the elongated hole 14, the omission resulting in the cut edges 35 and 36.

When it is desired to insert or remove papers, both slides 220, 221 are moved to the pushed-in position. To prepare the file for hanging, the two slides are pulled out in opposite directions by hand to the operative or suspension position, which is reproduced in FIG. 7 in the case of the slide 221, slide 220 being shown in the pushed-in position. When both slides are pulled out, the file complete with protective cover 1 and documentation, can readily be lowered onto two mutually parallel rails or similar suspension carriers 33 so as to be hung therefrom.

The embodiments of FIGS. 4 to 6 and FIGS. 7 and 8, have a common feature wherein the alignment of their suspension elements in relation to the plane of the main sections 13 is such that the support zones 25 and 30 are each disposed across a narrow side of the slide. These arrangements make it possible to hang up the file if, when they are assembled in their protective covers 1, the main sections 13 are vertically orientated when suspended. That is, both embodiments are designed for attachment to the rear cover boards 4.

Instead of the preferred design of the slides as punchings which in particular can comply with stringent strength requirements, it is also possible to make them, for instance, as injection-mouldings or castings of synthetic plastics material. Furthermore, it should be pointed out that where ring mechanisms whose ring components 8 extend beneath the mechanism cover 9 and do not pass through openings in the said cover, the slides can all be provided with openings in the neighbourhood of their edge flanges 17, 18, as indicated in the case of the flange 17, by the broken lines 37 of FIG. 8.

The embodiment of FIGS. 9 and 10 again illustrates a ring mechanism 7, of the kind already discussed in connection with the preceding examples, attached to the spine 3 of the protective cover 1.

Figure 9:
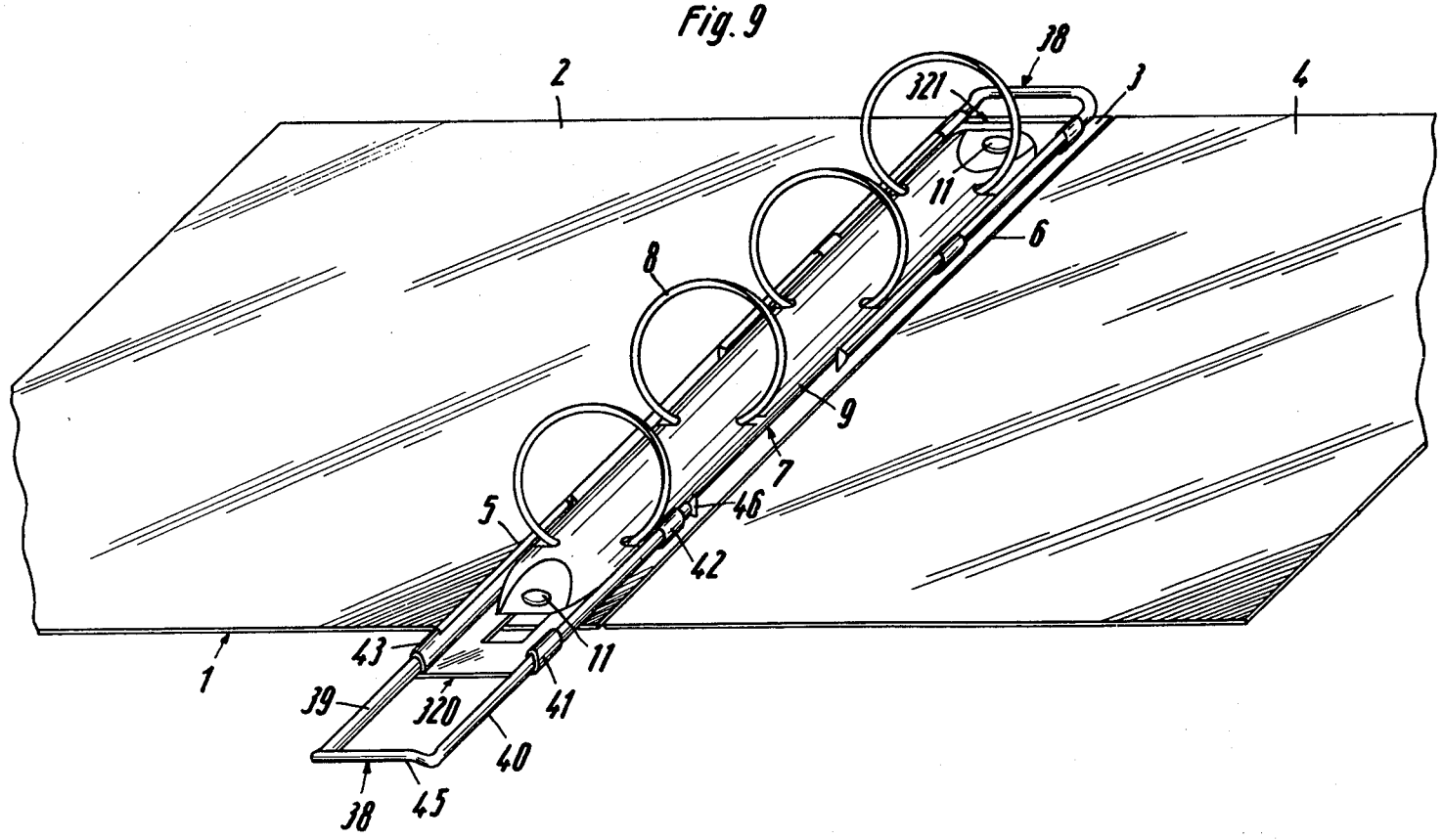
FIG. 9 is a cut-away perspective view of a filing device representing a fourth embodiment of the invention.
Figure 10:
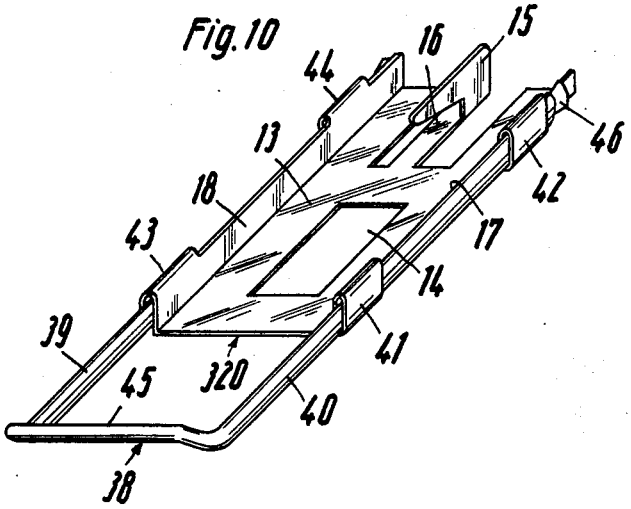
FIG. 10 is a perspective view of a slide and suspension bracket of the filing device shown in FIG. 9.

The filing device of FIGS. 9, 10 comprises two slides 320, 321 which substantially correspond with the slides of previous embodiments, parts thereof in common with parts of the previous embodiments having the same reference numbers. The modifications made can best be appreciated from a consideration of FIG. 10, which illustrates the slide 320. The essential difference resides now in the fact that the slide 320, like its counterpart 321, forms a mounting for a suspension bracket 38, consisting of elliptical-section wire bent to a U-shape. Inward-pointing legs 39, 40 of the bracket 38 secure and guide the bracket in relation to the exterior of the slide. To this end, the slide is provided with bearing bushes 40, 42, 43, 44 which are arranged in pairs and spaced at intervals from one another on each edge flange 17, 18. In the illustrated example, the bushes are formed by lugs bent up or rolled from the top edges of the flanges 17, 18. This makes it possible to form the overall slide as a simple sheet metal punching. The bearing bushes provide passages for the legs 39, 40 of the suspension bracket 38, the bushes being shaped to the cross-sectional shape of the legs 39, 40. Furthermore, the bushes are arranged in line with one another and so spaced from one another that the suspension bracket 38 can be pulled or pushed-in or out in a direction in which the slide itself is movable. The use of wire of elliptical-section keeps the overall width of the slide assembly to a minimum where the major axis of the cross-section is disposed parallel to the edge flanges 17, 18. In addition, such a wire section increases the resistance of the suspension bracket 38 to bending moments of the kind which occur when the laden file is suspended. The legs 39, 40 of the suspension bracket 38 define a support plane parallel to the main section 13 of the slide, which plane coincides in FIG. 10 with a plane containing the uppermost surfaces of the legs 39, 40. The outermost transverse limb 45, linking the legs 39, 40, lies to one side of the support plane, the legs being bent adjacent the limb 45 so that a hooked formation is produced. This construction secures a file suspended upon suspension carriers or rails from slipping off inadvertently. The innermost end 46 of the leg 40 is flattened to limit and determine the pulled-out position of the bracket 38 and at the same time to secure the suspension bracket 38 to the slide 320, 321 in captive fashion.

FIG. 9 illustrates the slide 320 and its suspension bracket 38, in the pulled-out position, whilst the slide 321 with its suspension bracket 38, is shown in the pushed-in position. For suspension of the file, both slides are pulled out in order to lock the ring components 8. Thereafter, the file complete with the documentation therein, can be suspended upon a pair of suspension carriers provided that the gap therebetween is wide enough to accept the file cover. If the gap between the suspension carriers is greater than the spacing between the support zones of the brackets 38 when the latter are pushed-in, then the latter can be pulled out to the extent required to bridge the gap. This is particularly important in the case of files for DIN A 5 format documentation, should it be desired to suspend such files from suspension carriers intended for use with DIN A 4 format documentation files. The quoted format classification is, of course, merely exemplary.

Figure 12:
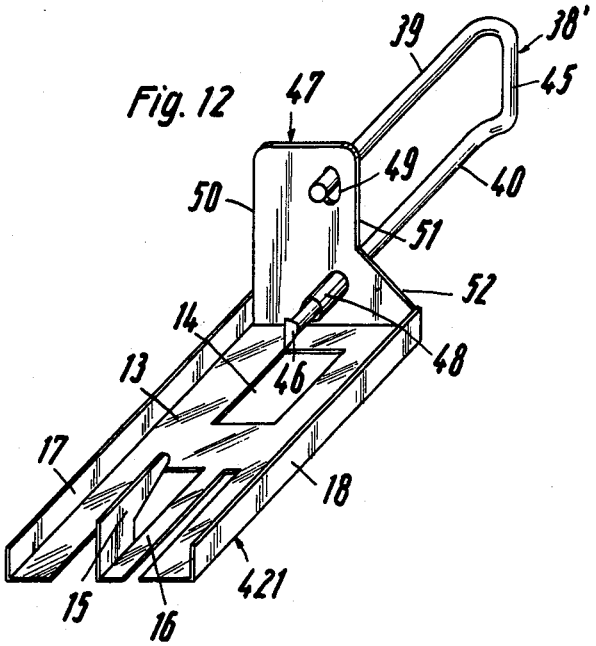
FIG. 12 is an illustration, similar to FIG. 10, of a slide and suspension bracket of the filing device shown in FIG. 11.
Figure 11:
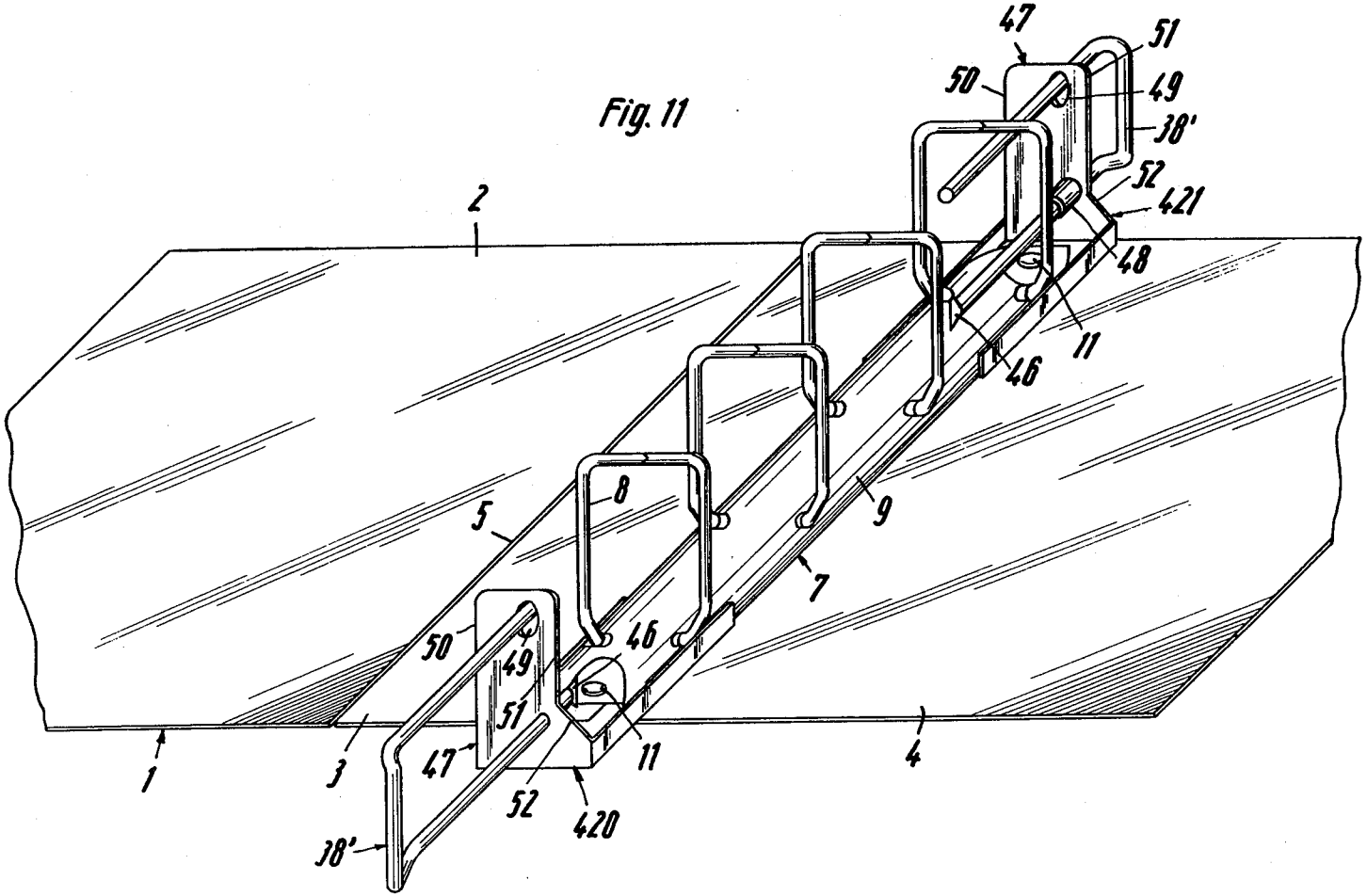
FIG. 11 is a view similar to that of FIG. 9, showing a fifth embodiment of the invention.
Figure 13:
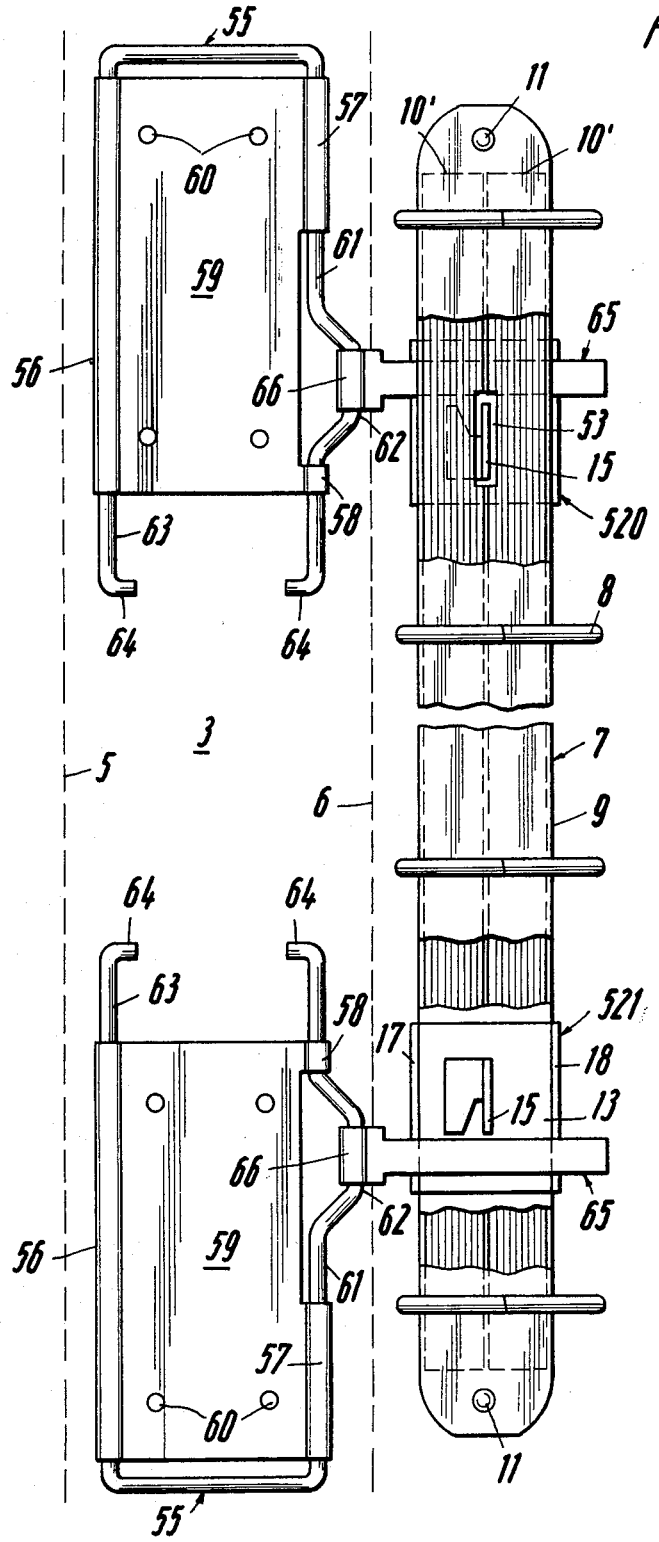
FIG. 13 is a locally exploded illustration of a filing device forming a sixth embodiment of the invention, with slides and suspension brackets in the pushed-in or retracted position.

The file and filing device shown in FIGS. 11 and 12 corresponds in many respects with those shown in FIGS. 9 and 10, and corresponding items have been marked with corresponding references. In FIGS. 9 and 10, the ring mechanism 7 was attached to the spine 3, but in FIGS. 11 and 12, it is attached next to the spine 3, to the rear board 4 of the protective cover 1. In this instance, the ring components 8 are not of circular form, but have a substantially rectangular shape. The slides 420, 421 each include a carrier flange 47 at the outer end of the main section, flange 47 being bent over towards the ring mechanism 7. This flange 47 contains lead-throughs consisting of openings for the legs 39, 40 of the suspension bracket 38'. These openings are disposed vertically one above the other and serve to dispose the suspension bracket 38' and the support plane defined by its legs at right angles to the main section 13 of the slide. The leg 40, in the illustrated example, is guided in a bush 48 formed by a sleeve attached to that side of the carrier flange 47 which faces the ring mechanism. The other opening is formed by an oval hole 49 in the carrier flange 47. The longer dimension of the hole 49 is parallel to the support plane of the suspension bracket 38' and hence is perpendicular to the plane of the main section 13. By making the hole 49 oval, compensates for certain manufacturing tolerances and avoids the need for uneconomically high precision in manufacture, so that this slide can likewise be manufactured as a simple punching or pressing prior to fitting with a sleeve 40 serving as a guide and bearing portion.

The slides 420, 421 are each assigned to the ends of the ring mechanism 7 in such a fashion that a straight edge 50 of the flange 47 is disposed at right angles to the plane of the main section 13 adjacent the spine 3 of the file cover. The edges 50 accordingly serve to support the spine 3 when the file is suspended. The opposite edge of each of the carrier flanges 47 is provided with a cut-out delimited by the lines 51, 52 so as to improve access to documentation in the file.

The suspension bracket 38' is similar to the bracket 38 shown in FIGS. 9 and 10, but the leg 39 is now shorter than the leg 40 by approximately the axial length of the sleeve 48.

In FIG. 11, the slide 420 and its suspension bracket 38' have been shown in the pulled-out position whilst the slide 421 and its suspension bracket 38' have both been shown in the pushed-in position where they are contained within the profile of the protective cover 1.

The embodiment shown in FIGS. 13 to 16 again comprises a ring mechanism 7 of the basic design already described hereinbefore, except that instead of ring coil components 10, ring strip components 10' are used. These contain a punched-out opening 53 for the locking tongue 15 on the slides 520, 521. The slides 520, 521 in turn have a flat main section 13 with a locking tongue 15, and upright marginal flanges 17, 18. The slides are located beneath the ring mechanism and between the latter and the back board 4 to which the ring mechanism 7 is attached by rivets 11. The slides 520, 521 which can perform oppositely directed motions towards the ends of the ring mechanism 7 into an operative position, perform a direct locking function upon the ring components 8 of the mechanism 7 but themselves always remain within the profile of a protective cover and also remain beneath the ring mechanism.

Each suspension element is formed by a substantially U-shaped suspension bracket 55 which is coupled to the slide in order to displace the latter. The bracket is however, positioned alongside the slide and is arranged to pivot with respect to the slide about a pivot axis parallel to the direction of motion of the slide. The suspension bracket 55 is supported for displacement by a separate fixture plate 59 provided with longitudinal guides 56, 57, 58, the plate 59 in turn being attachable by rivets 60 to the spine 3 of a protective cover 1. The longitudinal guides 56, 57, 58 are formed by rolled edge portions of the fixture plate 59, and between the guides 57 and 58 a space is formed at the level of which one bracket leg 61 facing its particular slide is provided with a cranked portion 62. The ends 64 of legs 61, 64 of the suspension brackets 55 are bent inwardly towards each other in order to limit outward displacement of the bracket. In the neighbourhood of the cranked portion 62, the leg 61 is engaged by a driver in the form of a transverse link 65 passing through punched-out openings in the edge flanges 17, 18. The link 65 has a bearing bush 66 formed at one of its ends by a rolling operation, the bush pivotally receiving the cranked zone 62 of the leg 61. No relative axial displacement is possible between the leg 61 and the bush 66.

The connecting link 65 is so accommodated in the associated slide 520 or 521, that it can perform a small transverse movement, whereby a mobile coupling between the slides and their associated suspension brackets 55 is created. Then, the brackets can be made particularly strong and robust, and independent in design, and dimensions of the slide and the ring mechanism 7 beneath which the slides extend. At the same time, because of the transverse mobility of the transverse links 65 and the pivotal attachment of the cranked zones 62 of the suspension brackets 55, the spine 3 can fold or hinge freely and without binding relative to the back board 4 of the protective cover.

Figure 14:
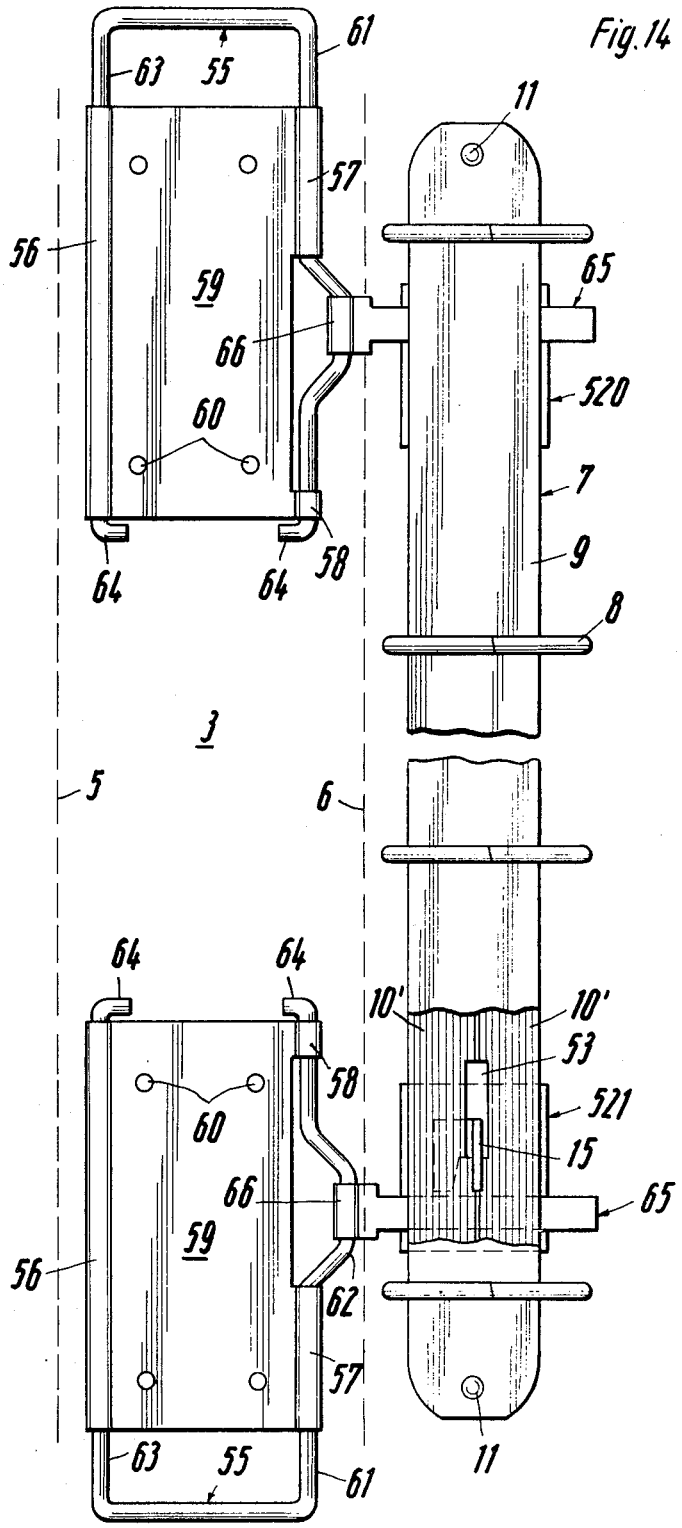
FIG. 14 is an illustration, similar to FIG. 13, showing the filing arrangement with its parts in their operative positions corresponding to use in the suspended attitude.
Figure 15:
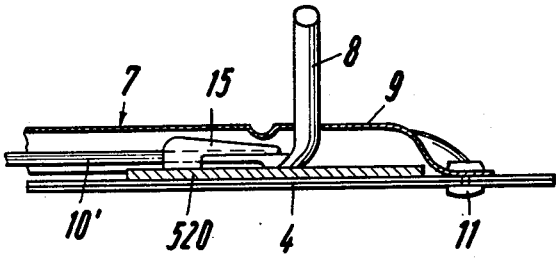
FIG. 15 is a longitudinal elevation view with parts in section of one end of the ring mechanism as shown in FIG. 13.
Figure 16:
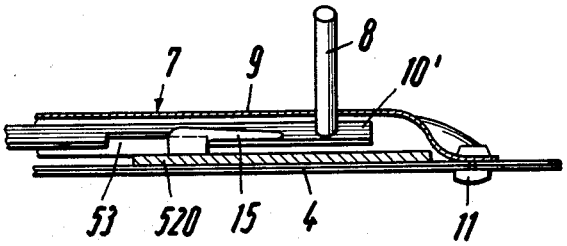
FIG. 16 is a longitudinal elevation view with parts in section of one end of the ring mechanism as shown in FIG. 14.
Figure 19:
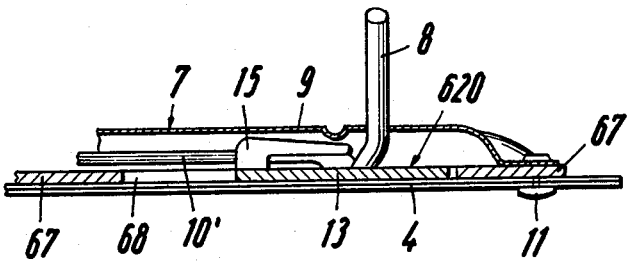
FIG. 19 is a simplified longitudinal elevation with parts shown in section of one end of the ring mechanism of the filing device shown in FIG. 17, with the slide thereof in the pushed-in position.
Figure 20:
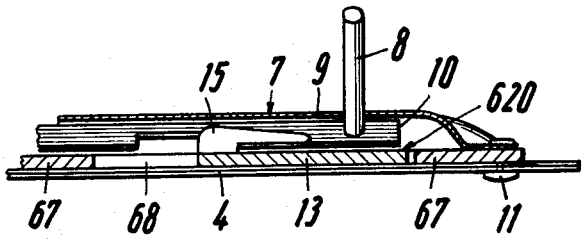
FIG. 20 is a view similar to FIG. 19 showing the parts when the slide is pulled out into the operative position thereof.

FIG. 14 illustrates the parts in an operative position to which the suspension brackets 55 are the only parts to project beyond the profile of the protective cover, the slides 520, 521 being in the locking position in which they secure the ring components 8 of the ring mechanism 7 against opening. This locking can be seen particularly clearly by comparing FIGS. 15 and 16, FIG. 15 illustrating the slide 520 in its unlocked position and FIG. 16 the components in the locked position.

The embodiment shown in FIGS. 17 to 20, finally, is similar to that shown in FIGS. 13 to 16, and commences from a ring mechanism 7 which is provided with an underlying base plate 67.

This base plate 67 possesses an external profile corresponding to the outline profile of the cover plate 9, and is held in position between the latter and the back board 4 of the protective cover by rivets 11. The base plate 67 has accommodating openings 68 for the slides 620, 621, the edges of the openings 68 guiding and limiting sliding motions of the slides therein. The slides 620, 621 consist simply of flat main sections 13 with upstanding locking tongues 15, and along one exposed, outer side of each bearing bushes 69, 70 are formed by rolled edge lugs. These bearing bushes 69, 70 are arranged in line and spaced from one another, and in each case one leg 71 of an associated suspension bracket 72 is assembled in the bushes 69, 70. The brackets each possesses a shorter second leg 73. In order that the longer leg 71 of each suspension bracket 72 is supported in the bearing bushes 69, 70 for pivoting and not for displacement longitudinally, the leg 71 is provided with a cranked portion 74 between the bushes 69, 70.

Figure 17:
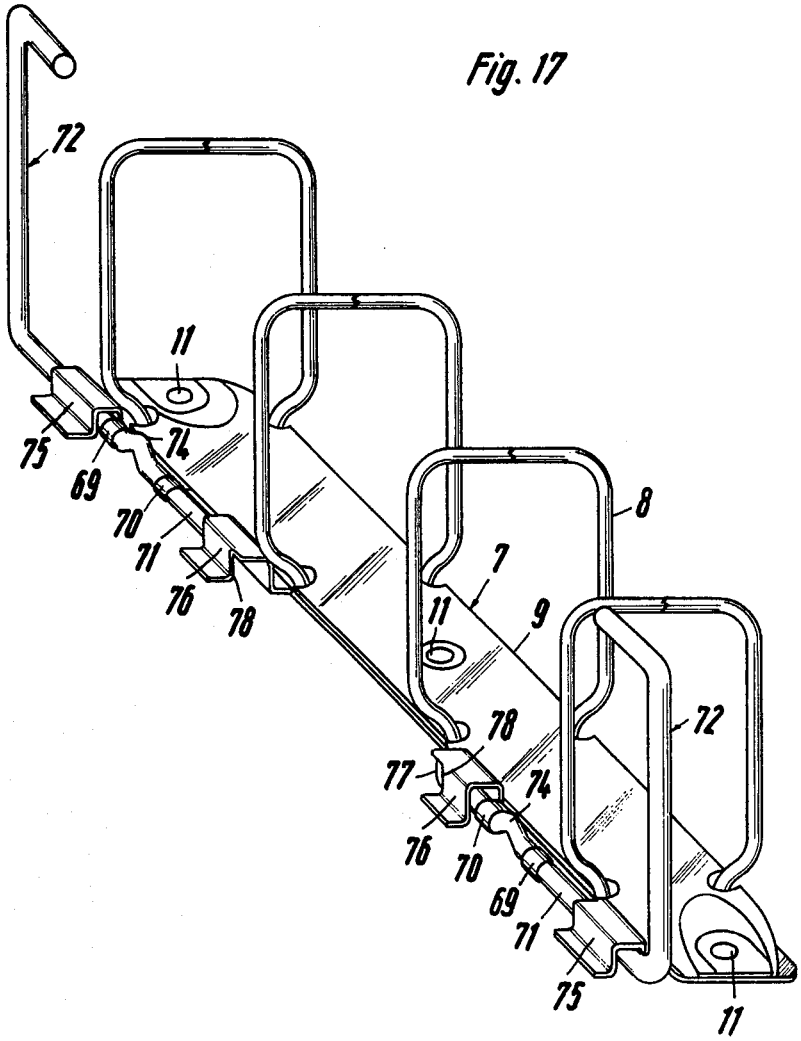
FIG. 17 is an overall perspective view of a filing device representing a seventh embodiment of the invention.
Figure 18:
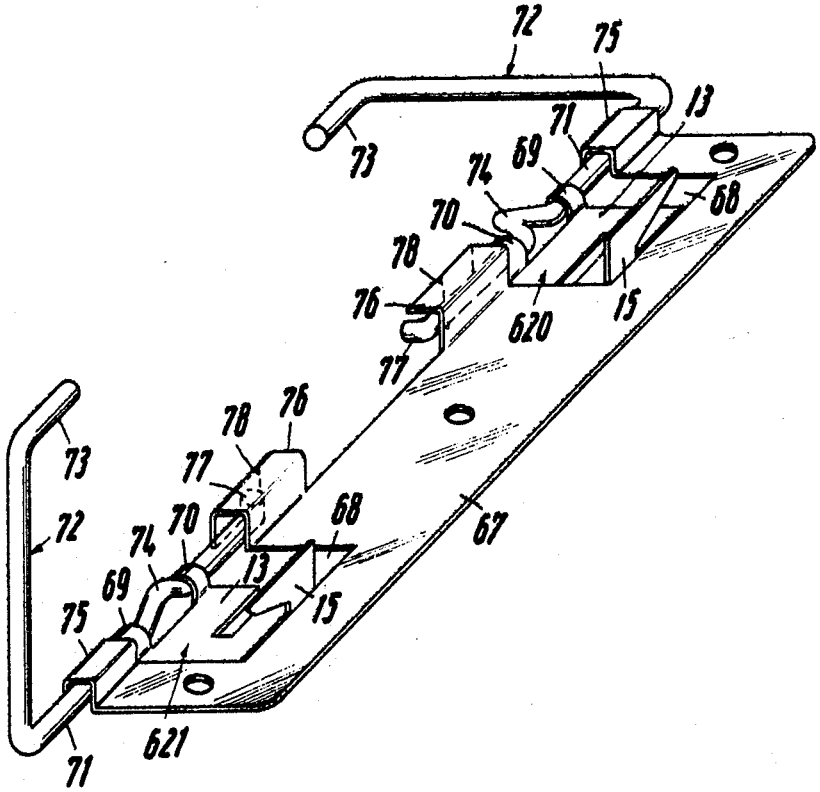
FIG. 18 is a detailed perspective view of part of the filing device shown in FIG. 17.

The base plate 67 has pocket-like extensions 75, 76 formed by folding operations, the extensions having a substantially U-shaped form. A pair of the extensions 75 and 76 embrace and guide the leg 71 of one suspension bracket 72, a second pair of extensions 75, 76 being provided for the leg 71 of the other bracket 72. The end 77 of the leg 71 of each suspension bracket 72 is bent over or hooked and its dimensions are so related to the inside dimensions of the extensions 76 that when slide and suspension bracket are in the pushed-in position, the bracket can be pivoted into a plane parallel to the base plate 67, and also through 90° into an upright position as shown in FIG. 17. To this end, the extension 76 has a shortened outwardly-facing wall, shortened as depicted by the edge 78. In order to pull out the suspension bracket 72 complete with its slide, into the file-suspension position, the suspension bracket 72 must be in a position in which it is perpendicular to the base plate 67, as shown in FIG. 17 in respect of the brackets 72 shown at top left, and in FIG. 18 in respect of the bracket shown at bottom right. In this position, the bracket 72 has its hooked end 77 fully engaged in the extension 76, and cannot therefore pivot.

To prepare the file for it to be stored in suspended fashion, it is merely necessary to swing up the suspension brackets 72 and to pull them apart in opposite directions, the brackets 72 taking the slides 620, 621 with them and moving them into the position in which they lock the ring mechanism 7. The locking of the brackets 72 in relation to the base plate 67, in the suspension position, means that when suspended the file has a vertical attitude, whilst when the components are in the pushed-in position, the suspension brackets 72 can be freely folded down on to the spine 3, in which position they do not impede normal use of the file.

we claim:

1. A filing device comprising a ring binding mechanism for attachment to the inside of a protective file cover having upper and lower edges, said ring binding mechanism having a sprung cover, ring carrying elements, and ring components carried pairwise by said ring elements for rocking movements thereby allowing said ring binding mechanism to be opened and closed, a slide disposed at each longitudinal end of said ring binding mechanism, each of said slides being slidably mounted for limited longitudinal displacement along said ring binding mechanism between an extended operative and a withdrawn inoperative position, and a locking element on said slide engageable with said ring carrying elements to secure said ring components of said ring mechanism against opening when said slide is displaced to said extended operative position, said locking element being disengaged from said ring carrying elements when said slide is disposed in said withdrawn inoperative position such that said ring binding elements are free to be opened, suspension means, mounting means mounting said suspension means on said slide and providing for relative movement between said suspension means and said slide, said suspension means being movable relative to said slide to an extended position, said suspension means having a support portion extending beyond the corresponding longitudinal end of said ring mechanism and beyond said edges of said protective file cover when said slide is in said extended operative position and said suspension means is in said extended suspension position, thereby enabling the device to be suspended from spaced carrier rails of a file carrier, said suspension means being movable relative to said slide to a retracted non-suspension position disposed substantially within said protective file cover when said slide is in said withdrawn inoperative position.

2. A device as claimed in claim 1, wherein said suspension means comprises a substantially U-shaped suspension bracket having opposed legs, said U-shaped suspension bracket being movable longitudinally with respect to said slide.

3. A device as claimed in claim 2 wherein said slide has a generally flat main section, the opposed legs of said U-shaped suspension bracket defining a support plane disposed parallel to the flat main section of said slide.

4. A device as claimed in claim 3, wherein edge flanges are provided on the opposite edges of said main section of said slide, said edge flanges having bushings defining said mounting means which receive and guide the legs of said suspension bracket.

5. A device as claimed in claim 4, wherein said bearing bushings comprise bent-over extension lugs which extend from the tops of said edge flanges, said lugs providing for each leg two spaced-apart aligned bearing bushings.

6. A device as claimed in claim 3, wherein said suspension bracket is made of wire of elliptical cross-section, the major axis of the elliptical section being disposed normal to said support plane.

7. A device as claimed in claim 2, wherein said slide has a generally flat main section the opposed legs of said U-shaped suspension bracket define a support plane disposed at right angles to the flat main section of the slide.

8. A device as claimed in claim 7, wherein an outer end of said slide is provided with a carrier flange disposed at right angles to said main section of said slide, said carrier flange containing opening means for said opposed legs of said suspension bracket and one of said opening means comprising a bearing bushing.

9. A device as claimed in claim 8, wherein said bearing bushing comprises a sleeve attached to a surface of said carrier flange which faces inwardly towards the ring binding mechanism.

10. A device as claimed in claim 8, wherein the other of said opening means comprises an oval hole.

11. A device as claimed in claim 2, wherein one end of at least one of the two opposed legs of said U-shaped suspension bracket is deformed in order to form a stop to prevent detachment of said U-shaped suspension bracket from said slide.

12. A device as claimed in claim 2, wherein said suspension bracket is bent adjacent its outer end to form a hook to prevent a file suspended thereby from slipping off the file carrier.

13. A device as claimed in claim 1, wherein said slide includes a main portion and a transverse flange generally perpendicular to said main portion, said transverse flange having an edge which becomes the bottom edge when the filing device is suspended from the file carrier, said suspension means comprising a suspension bracket pivotally mounted about an axis parallel to said edge.

14. A device as claimed in claim 13, wherein said transverse flange has a rolled edge which serves as the pivot bearing for said suspension bracket.

* * * * *